United States Patent [19]

Walter

[11] Patent Number: 4,813,552

[45] Date of Patent: Mar. 21, 1989

[54] CLOTHES DISPLAY STAND

[75] Inventor: Herbert Walter, Müllheim, Fed. Rep. of Germany

[73] Assignee: Protoned B.V., Herengracht, Netherlands

[21] Appl. No.: 73,453

[22] Filed: Jul. 15, 1987

[30] Foreign Application Priority Data

Aug. 8, 1986 [CH] Switzerland ..... 3200/86

[51] Int. Cl.[4] ..... A47H 1/02

[52] U.S. Cl. ..... 211/105.1; 211/208; 211/204

[58] Field of Search ..... 211/105.1, 208, 204, 211/128, 206, 123, 105.3, 190, 105.4, 105.5, 16, 103

[56] References Cited

U.S. PATENT DOCUMENTS

| | | | |
|---|---|---|---|
| 3,071,253 | 1/1963 | Walsh et al. | 211/204 |
| 3,286,850 | 11/1966 | Ruhnke | 211/105.1 |
| 4,181,230 | 1/1980 | Acuff | 211/208 |
| 4,253,578 | 3/1981 | Rekow | 211/208 |
| 4,316,547 | 2/1982 | Varon | 211/105.1 |

*Primary Examiner*—Reinaldo P. Machado
*Assistant Examiner*—Sarah A. Lechok Eley
*Attorney, Agent, or Firm*—Ladas & Parry

[57] ABSTRACT

The extension arms (3) attached to the clothes display stand so as to be vertically adjustable are inclined obliquely downwards at an angle $\alpha$ of approximately 105° relative to their supporting arrangements (1, 2). They are provided, on their top side, with V-shaped grooves (6), in which clothes-hangers can be suspended in a horizontally and vertically staggered arrangement.

10 Claims, 4 Drawing Sheets

CLOTHES DISPLAY STAND

Figure 1A:
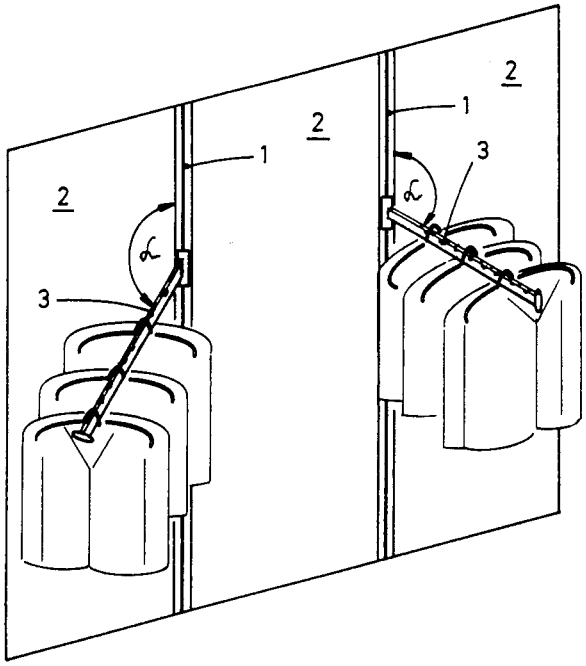

For displaying articles of clothing in showrooms and sales areas, it is of essential importance that it should be possible for a maximum number of articles of clothing to be displayed to the best possible effect in a predetermined section of space. One possibility of achieving this is to hang the individual articles of clothing offset relative to one another, so that not only a relatively large area of the particular article of clothing at the front, but also at least a narrow vertical portion of those behind it is visible. Such stands have become known in a first embodiment, for example from German Patent Specification No. 2,941,648 and German Offenlengusschrift No. 2,916,226, and in these stop pins attached eccentrically to oblique supporting rods offset relative to one another are used as retention means for conventional clothes-hangers. These retention means ensure that the suspension hooks of clothes-hangers resting freely on the supporting rods have a natural tendancy to swing out, and, as seen in a horizontal projection, this results in an inclination of the clothes-hangers of approximately 60° relative to the longitudinal axis of the supporting rods, the arrangement of the supporting rods themselves ensuring efficient utilization of space.

Although, when two adjacent articles of clothing are movable to a sufficient extent, the inclination of the clothes-hangers automatically results in the desired exposure of the displayed articles, nevertheless, if the garments rest flush against one another, the adhesion occurring thereby is sufficient to impede a free movement. The garments then have to be moved by hand, so that the desired display effect can be achieved.

European Patent Application No. 0,069,876 shows a clothes stand, in which the supporting arms preferably projecting radially from a central column are equipped with a plastic covering which has a comb-like bearing portion for receiving the suspension hooks of clothes-hangers. The comb teeth are at an angle of approximately 60° relative to the longitudinal axis of the supporting arms and give the suspension hooks of the clothes-hangers a corresponding obligatory inclination, so that there is no need to align the clothes-hangers with one another. Although the comb-like bearing portion is capable of producing the desired aligning effect on the clotheshangers, the provision of the plastic covering means that there is a restriction to standard lengths, and the shaping of the teeth on the plastic covering is not without its problems.

The object of the invention is to provide a clothes display stand according to the pre-characterizing clause of patent claim 1, in which, in particular, the benefits of a fixed index retention toothing on the extensionarms are also utilized, but which, furthermore, is equipped with a specific toothing which is simple to make. Moreover, extension arms on the stand structure will be made removable, to allow the best possible utilization of a particular showroom area.

The solution for achieving the object arising from this emerges from the characterizing features of patent claim 1. Embodiments thereof are defined by the dependent claims.

Figure 3A:
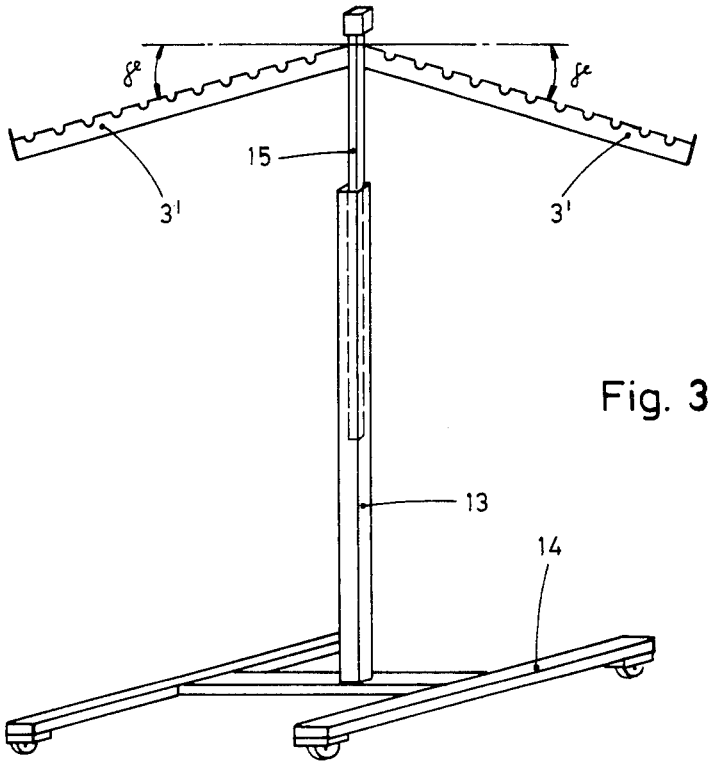
Figure 3B:
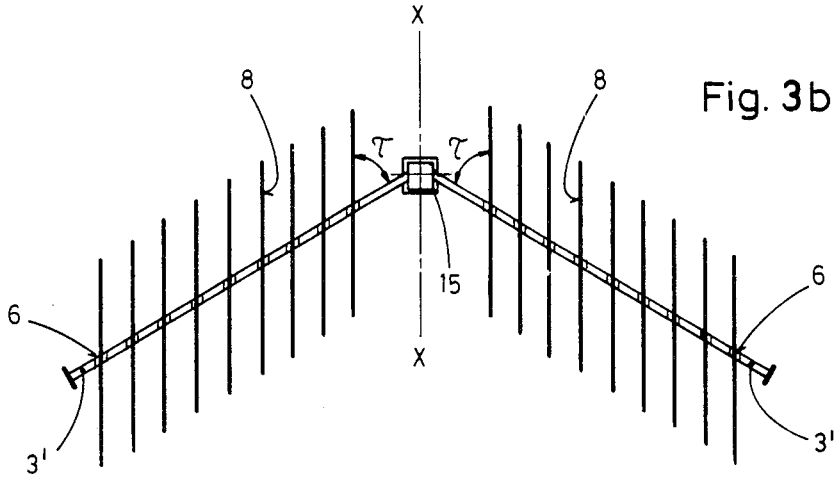
Figure 4A:
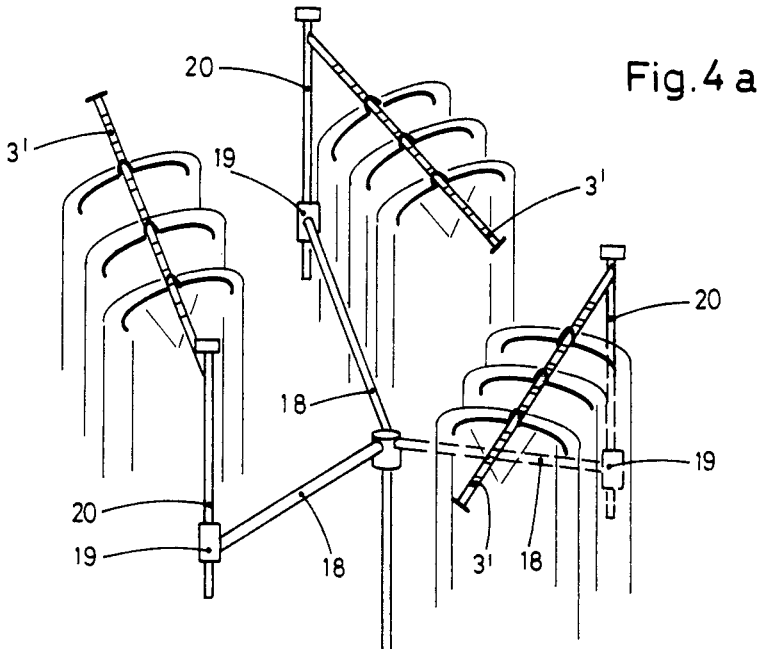
Figure 4B:
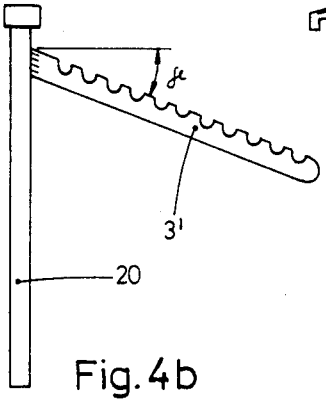
Figure 4C:
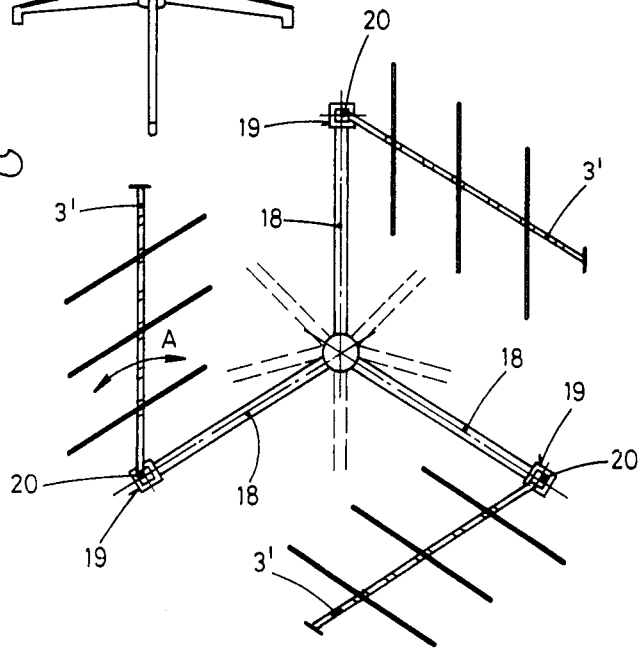

The invention is explained below by way of example with reference to the drawing. In the drawing:

FIGS. 1*a* to *c* and 2*a* to *c* show the clothes display stand according to the invention in two typical wall-mounted embodiments, with the clothes supporting arrangement in a perspective representation, a plan view and a side view (FIGS. 1*c*, 2*c*) respectively;

FIGS. 3*a* and 3*b* show a single-column embodiment with a vertical tube and a fixed or movable foot arrangement and with extension arms which are arranged fixedly on a pull-out tube vertically adjustable telescopically in the vertical tube; and FIGS. 4*a* to *c* show a further single-column embodiment with horizontal radial jibs, to the end of each of which is fixed a vertically adjustable pull-out tube with a clothes-hanger extension arm.

Figure 1B:
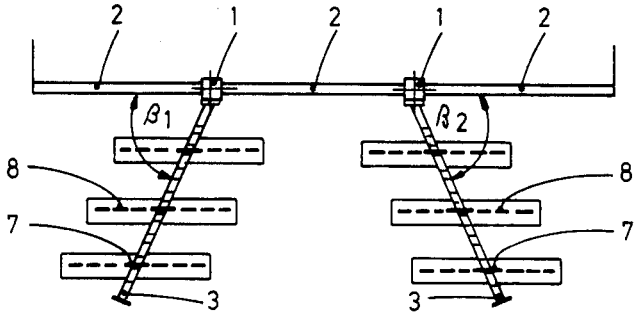
Figure 1C:
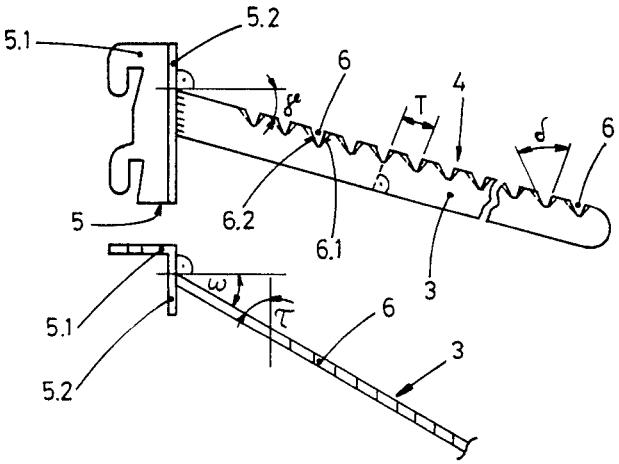

FIG. 1*a* shows a first embodiment of the clothes display stand according to the invention, where extension arms 3 with a notch arrangement 4 according to FIG. 1*c* can be suspended at selectable heights in a known way on column members 1 or other supporting or fastening means of a room-dividing or rear-wall arrangement composed of wall elements 2. The extension arms are inclined downwards approximately at the angle $\alpha = 90 + 15° = 105°$.

In the plan view of FIG. 1*b*, the two extension arms 3 shown in the perspective drawing can be seen in their angular relationship relative to the wall elements 2. The extension arm on the left is at an acute angle $\beta_1$ to the wall elements 2 in the lefthand direction, whilst the extension arm on the right is at an approximately identical angle $\beta_2$ to these in the righthand direction. The angles $\beta_1$ and $\beta_2$ are each approximately $90 - 30° = 60°$, so that the articles of clothing hang approximately parallel to the wall. Of course, the inclination of adjacent extension arms on one and the same wall arrangement can be selected so as to be in a uniform direction to the left or the right. This is governed by the relative position of a clamping member 5 on the extension arm 3, as can be seen in FIG. 1*c*. The extension arm 3 having the notch arrangement 4 is attached at an angle $\gamma$ of approximately 15° to this clamping member 5 which is composed of a hooked plate 5.1 stamped from a flat strip material and of a shield plate 5.2 matching the surface of the column member 1. The extension arm 3 is at an angle $\omega$ of approximately 30° relative to the hooked plate and contains V-shaped grooves 6, the lower flank 6.1 of which is approximately at right angles to the direction of the extension arm, whilst the upper flank 6.2 is inclined upwards at an angle $\delta$ of 35°–38°. Moreover, as seen from above, the grooves 6 are at an oblique angle $\tau$ of approximately 60° to the extension arm 3. As a result of this inclination of the grooves 6 which are approximately 10 mm deep and are at a division T of approximately 20–25 mm, the hooks 7 shown diagrammatically (in FIG. 1*b*) and belonging to the clothes-hangers 8 urge the latter into an appropriate inclination relative to the extension arm 3. This necessarily produces the desired staggered display of the articles of clothing placed on the hangers 8.

It goes without saying that the inclination of the grooves 6 at the angle z can also be made mirrorsymmetrical, so that an opposite inclination of the clothes-hangers can be obtained. See also FIG. 3*b* in this respect.

Figure 2A:
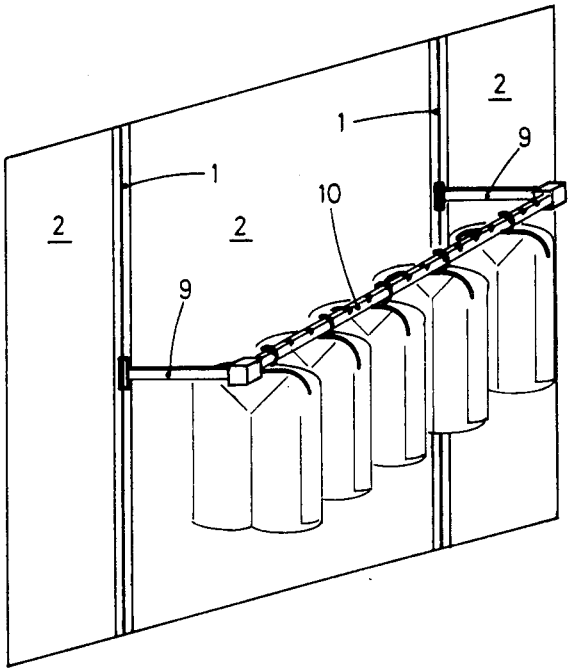

FIG. 2*a* shows a second embodiment of the clothes display stand, in which a room-dividing or rear-wall arrangement according to FIG. 1*a* can be used once again as a supporting device. Suspended on the column members 1 are horizontal jibs 9, to the front end of each of which is fastened one end of a supporting rod 10 performing the function of an extension arm 3 and having a notch arrangement 4 according to FIG. 1*c*, shown diagrammatically. According to FIG. 2*c*, and in a similar way to FIG. 1*c*, the supporting rod 10 runs between the column members 1 at the angle $\gamma$ of approximately 15°, the inclination being either in the clockwise direction or in the anti-clockwise direction. The height difference H between the jibs 9 which results from this corresponds to an even multiple of the distance between adjacent indexed suspension points on the column members 1. As shown by the plan view FIG. 2*b*, the clothes-hangers 8 are oblique relative to the supporting rod at the angle This inclination can be in the lefthand or the righthand direction, as required.

A single-column embodiment of the clothes display stand is shown in FIGS. 3*a* and 3*b*. A vertical tube 13 arranged on a fixed or movable foot arrangement 14 guides a pull-out tube 15 movable telescopically and lockable in its interior. Attached to the top end of the pull-out tube 15 is a number (2 in the example) of extension arms 3 which are each equipped with a notch arrangement 4 (FIG. 1*c*)and which are inclined outwards and downwards at an angle $\gamma$ of approximately 15° in a similar way to the embodiments described previously. There can, per se, be any number of extension arms 3'. In the two-armed embodiment illustrated in FIG. 3*b*, the arms 3' are arranged in a V-shaped formation at an angle of approximately 120° to one another, and they are arranged symmetrically relative to the plane X—X of the pull-out tube. This, in conjunction with the angling $\tau$ of the grooves 6 (FIG. 1*c*) which, as mentioned, can be directed to the left or to the right on the arms 3', ensures that the clothes-hangers 8 on the two arms 3' are in a parallel position.

Finally, FIGS. 4*a* to 4*c* show an embodiment of the clothes display stand which is based on a single-column supporting device 16, where 3 horizontal jibs 18 distributed symmetrically project from the top end of a vertical tube 17. Each of these jibs 18 has, at its radially outer end, a fixing device 19, in which rotationally indexable pull-out tubes 20 are held in a known way so as to be vertically displaceable (and lockable). Each pull-out tube 20, shown individually in FIG. 5*b*, carries, at its top end, an extension arm 3' connected firmly to the pull-out tube 20. As mentioned previously, the angle of inclination $\gamma$ of the extension arm 3' is approximately 15°.

It can be seen from the plan view (FIG. 4*c*) how the pull-out tubes 20 can be set in specific angular positions relative to the horizontal jibs 18 by means of the rotationally indexable fixing devices 19. If the pull-out tubes 20 are pivoted vertically, preferably uniormly, in the direction of the arrow A in the fixing devices 19, clothes display stands according to FIGS. 4*a* to 4*c* can easily be adapted to garments of differing size.

I claim:

1. A clothes display stand with at least one extension arm (3, 3'; 10) attached to a supporting arrangement (1.2; 13; 16) so as to be vertically adjustable and composed of flat-strip material having a top side, with means (4) for suspending clothes-hangers (8) in a horizontally and vertically staggered arrangement, in such a way that the best possible viewing range for display purposes is obtained for articles of clothing resting on them next to one another, wherein each extension arm (3, 3'; 10) is inclined downwards at a predetermined angle ($\alpha$ or $90°+\gamma$) relative to the supporting arrangement, and wherein the means for suspending the clothes-hangers (8) are a notch arrangement (4) provided on the top side of the flat-strip extension arm (3, 3'; 10) and comprising a number of V-shaped grooves (6) which are made at approximately uniform distances ($\tau$) from one another along the extension arm (3, 3'; 10) and which extend obliquely at a predetermined acute angle ($\tau$) relative to the longitudinal direction of the extension arm (3, 3'; 10).

2. A clothes display stand as claimed in claim 1, the supporting arrangement (1, 2) comprising a number of column members (1) aligned linearly with one another and wall zones or wall elements (2) located between them, wherein the extension arms (3) are deflected relative to the direction of alignment of the supporting arrangement (1, 2) at an angle ($\beta$) dependent on the groove inclination ($\tau$) on the extension arm (3) (FIGS. 1*a* and 1*b*).

3. A clothes display stand as claimed in claim 1, the extension arm (3) being equipped with a clamping member (5) or selective attachment in engagement orifices (12) of the supporting arrangement (1,2; 11), wherein the clamping member comprises a hooked plate (5.1) and a shield plate (5.2), to which the extension arm (3)is fastened (FIG. 1*c*).

4. A clothes display stand as claimed in claim 3, wherein the extension arm (3) is fastened to the shield plate (5.2) at an angle ($\omega$) of approximately 30°.

Figure 2B:
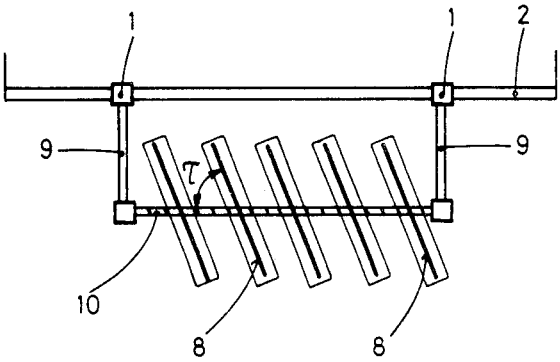
Figure 2C:
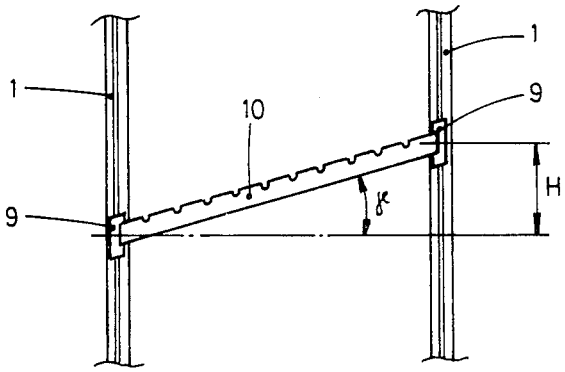

5. A clothes display stand as claimed in claim 1, the supporting arrangement (1, 2) comprising a number of column members (1) aligned linearly with one another and wall zones (2) located between hem, wherein the extension arm (10) is held by horizontal jibs (9) supported on adjacent column members, in such a way that it extends at an angle of inclination ($\gamma$) of approximately 15°, and the jibs (9), as regards their height difference (H), are offset relative to one another by an amount corresponding to an even-numbered height division of the suspension points on column member (1) (FIGS. 2*a* to 2*c*).

6. A clothes display stand as claimed in claim 1, the supporting arrangement (13 to 15) comprising a vertical tube (13), a foot arrangement (14) and a pull-out tube (15) which is telescopically displaceable relative to the vertical tube (13) and is lockable in the latter and to which are fastened a number of extension arms (3'), wherein two extension arms (3') are provided with grooves (6, 6') made in a mirror-image arrangement, in order to obtain a parallel arrangement of the clothes-hangers (8) of the two extension arms (3') (FIGS. 4*a* and 4*b*).

7. A clothes display stand as claimed in claim 1, the supporting arrangement being designed as a single column supporting device (16) with a central vertical tube (17) and with jibs (18) extending radially from the latter, wherein the jibs (18) are each equipped,at their radially outer end, with a fitting device (19) for receiving displaceably and fixing the height of a pullout tube (20), and wherein the pull-out tube (20) is equipped, at its upper end, with a radially projecting extension arm (3') which is inclined at an angle ($\gamma$) of approximately 15°.

8. A clothes display stand as claimed in claim 1, wherein the angle of inclination of the grooves (6) relative to the longitudinal direction of the extension arm (3, 3'; 10) is approximately 60° and can be to the left or to the right in relation to the longitudinal direction.

9. A clothes display stand as claimed in claim 1, wherein the grove opening angle ($\delta$) is between 35° and 38°.

10. A clothes display stand comprising at least one extension arm (3; 3'; 10) attached to a supporting arrangement (1, 2; 13; 16) so as to be vertically adjustable and composed of flat strip material, wherein the extension are is inclined downwards at a predetermined angle ($\alpha$ or $90° + \gamma$) relative to a vertical central plane (X—X) of the supporting arrangement, a notch arrangement (4) for suspending clothes hangers (8) on the top side of the ext4ension arm having a number of V-shaped grooves (6) which are made at approximately uniform distances (T) from one another along the extension arm, and wherein the downwardly inclined extension arms (3) are deflected relative to the central plane of the supporting arrangement (1) at an angle ($\beta_1$, $\beta_2$) of approximately 60°, and the V-shaped grooves (6) extend obliquely at an angle ($\tau$) relative to the longitudinal direction of the extension arm of approximately 60° and can be to the left or to the right in relation o the longitudinal direction corresponding to the left-hand or the right-hand angular relationship of the respective extension arm, relative to the central plane, in order to obtain a parallel arrangement of the clothes hanger (8) with respect to the central plane.

* * * * *